US011536114B2

(12) United States Patent
Nelson

(10) Patent No.: US 11,536,114 B2
(45) Date of Patent: Dec. 27, 2022

(54) FLUID FLOW ACTIVATED ROTATIONAL CLEANING TOOL

(71) Applicant: Halliburton Energy Services, Inc., Houston, TX (US)

(72) Inventor: Carl William Nelson, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 282 days.

(21) Appl. No.: 16/769,123

(22) PCT Filed: Jul. 2, 2019

(86) PCT No.: PCT/US2019/040383
§ 371 (c)(1),
(2) Date: Jun. 2, 2020

(87) PCT Pub. No.: WO2021/002856
PCT Pub. Date: Jan. 7, 2021

(65) Prior Publication Data
US 2022/0003078 A1 Jan. 6, 2022

(51) Int. Cl.
*E21B 37/10* (2006.01)
*B08B 9/045* (2006.01)
(Continued)

(52) U.S. Cl.
CPC ..... *E21B 37/10* (2013.01); *B08B 9/045* (2013.01); *E21B 34/06* (2013.01); *B08B 2209/04* (2013.01); *E21B 41/0078* (2013.01)

(58) Field of Classification Search
CPC ..... E21B 37/08; E21B 37/10; B08B 9/045; B08B 2209/04
See application file for complete search history.

(56) References Cited

U.S. PATENT DOCUMENTS 3,827,492 A * 8/1974 Hammon ..... E21B 37/02 166/173
3,908,771 A * 9/1975 Garrett ..... E21B 17/16 175/325.2
(Continued)

FOREIGN PATENT DOCUMENTS

EA 012903 B1 2/2010
EA 015116 B1 6/2011
(Continued)

OTHER PUBLICATIONS

International Search Report and Written Opinion of PCT Application No. PCT/US2019/040383 number dated Apr. 2, 2020.

*Primary Examiner* — Shane Bomar
(74) *Attorney, Agent, or Firm* — McGuireWoods LLP

(57) ABSTRACT

A system to clean well casing in a downhole well operation. The system comprises an inner collar having flow ports and an out collar having jet ports in fluid communication with the flow ports. The inner collar couples with a section of a tool string and the outer collar rotates about the inner collar in response to fluid flow through the tool string. The inner collar can include a sleeve. The sleeve can be moved from a first position to a second position causing the jet ports to be in fluid communication with the flow ports. The inner collar remains relatively stationary with respect to the rotation of the outer collar. In addition, the jet ports are angled in a way that a portion of force generated by the fluid flow through the jet ports induce rotation of the outer collar in the opposite direction of the fluid flow.

18 Claims, 10 Drawing Sheets

(51) Int. Cl.
*E21B 34/06* (2006.01)
*E21B 41/00* (2006.01)

(56) References Cited

U.S. PATENT DOCUMENTS 4,799,554 A 1/1989 Clapp et al.
4,919,204 A * 4/1990 Baker ..... E21B 37/04 175/100
4,979,561 A * 12/1990 Szarka ..... E21B 23/006 166/240
5,033,545 A * 7/1991 Sudol ..... E21B 43/124 134/167 C
5,195,585 A * 3/1993 Clemens ..... E21B 41/0078 166/222
5,337,819 A * 8/1994 Tailby ..... E21B 37/08 166/317
5,839,511 A * 11/1998 Williams ..... E21B 37/00 166/312
6,189,618 B1 * 2/2001 Beeman ..... E21B 34/14 166/194
6,336,502 B1 1/2002 Surjaatmadja et al.
6,371,208 B1 4/2002 Norman et al.
7,314,083 B1 1/2008 Martini
8,298,349 B2 10/2012 Wojciechowski et al.
9,399,230 B2 7/2016 Wojciechowski et al.
2015/0034136 A1 2/2015 Bakke et al.
2016/0008826 A1 1/2016 Schneider
2016/0069158 A1 3/2016 Coyle, Jr.

FOREIGN PATENT DOCUMENTS

RU 2244112 C1 1/2005
RU 2359114 C2 6/2009
RU 2408777 C1 1/2011
RU 161064 U1 4/2016
SU 99381 A1 11/1954
WO 2019104322 5/2019

* cited by examiner

FLUID FLOW ACTIVATED ROTATIONAL CLEANING TOOL

BACKGROUND

Development of a well site often requires tools to clean the Internal Diameter (ID) of well casing. Traditional methods of cleaning often involve fixing a cleaning tool on the end of a running tool, such as drill pipe, and cleaning the ID by channeling fluid through the ID of the running tool, and rotating the cleaning tool using the running tool. Furthermore, in order to clean 360° of the ID, often it requires the in and out tripping of the tool string, i.e. the up and down movement of the tool string. Another challenge is the activation and deactivation of these cleaning took when downhole well environment. Traditionally, activation and deactivation of the cleaning tools requires tripping the tools in and out of the well.

A particular challenge is to clean those areas of well casing that have a critical surface finish. For example, a casing liner is used to tie casing pieces together and until the pieces are tied together sections of the liner, i.e. a tie back receptacle and a bore receptacle (tie forward receptacle), must maintain a high degree surface finish in order to function properly. However, the very action of mechanically rotating and the tripping in and out of the running tool and the cleaning tool can damage these surfaces, as these processes are not always that stable. In summary, rotation of the running tool and cleaning tool and the in and out tripping of the tools can result in damage to the ID of the well casing.

BRIEF DESCRIPTION OF THE DRAWINGS

For a more complete understanding of the features and advantages of the present disclosure, reference is now made to the detailed description along with the accompanying figures in which corresponding numerals in the different figures refer to corresponding parts and in which.

DETAILED DESCRIPTION

Figure 1:
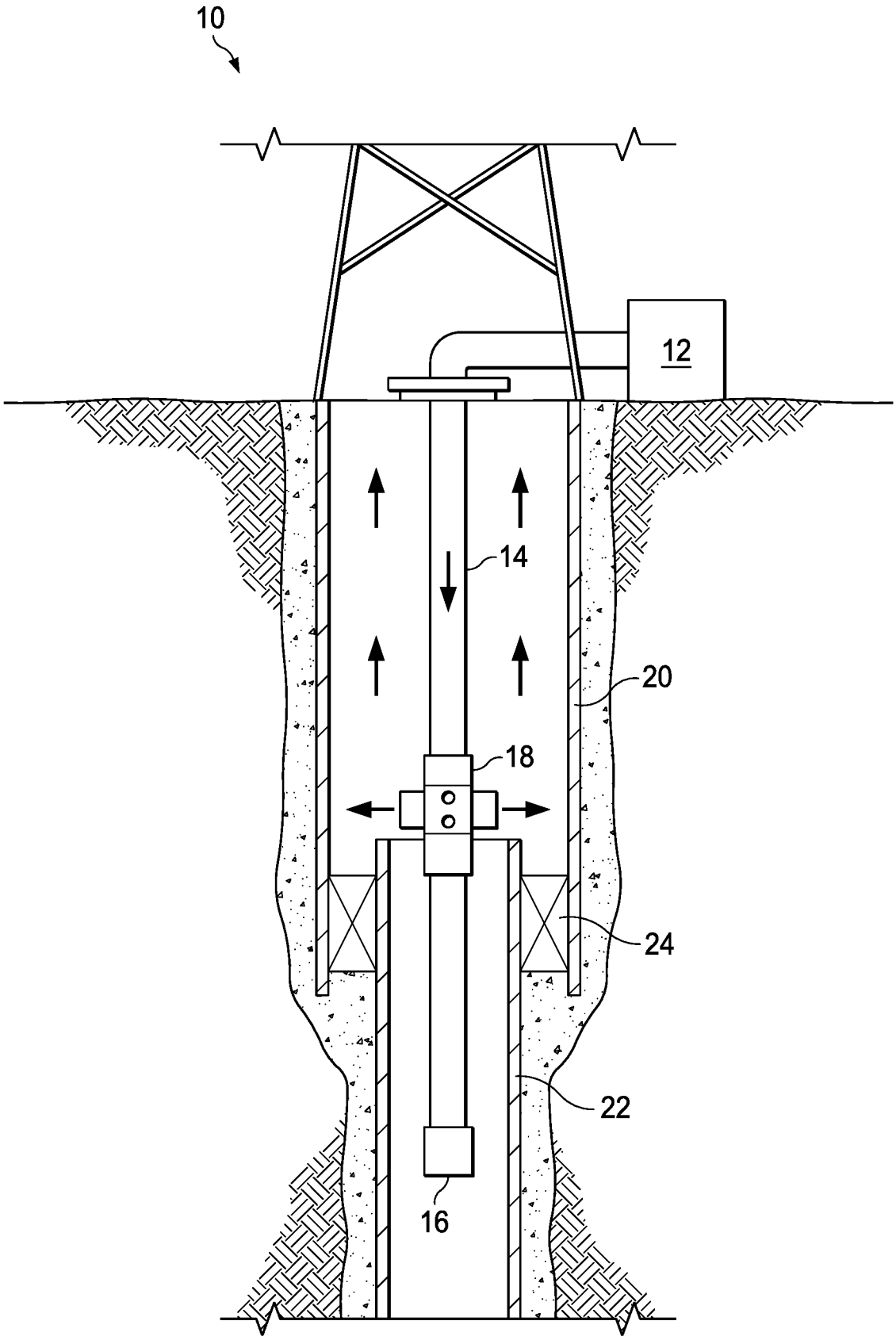
FIG. 1 is an illustration of a diagram of a well site where cleaning operations are performed, in accordance with certain example embodiments.

While the making and using of various embodiments of the present disclosure are discussed in detail below, it should be appreciated that the present disclosure provides many applicable inventive concepts, which can be embodied in a wide variety of specific contexts. The specific embodiments discussed herein are merely illustrative and do not delimit the scope of the present disclosure. In the interest of clarity, not all features of an actual implementation may be described in the present disclosure. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would be a routine undertaking for those of ordinary skill in the art having the benefit of this disclosure.

The present disclosure relates to a fluid flow activated rotational cleaning tool. The cleaning tool comprises a stationary inner collar fixed to a running tool and a free-floating, rotatable carrier, referred to herein as an outer collar, to channel fluid to the ID of well casing. The outer collar comprises ports. In response to the force of the flow of fluid through the ports, the outer collar is free to rotate while the inner collar and running tool remains stationary. Turbulence induced by the rotating collar cleans the ID of sections of casing, such as the liner hanger and tie back receptacle and riser. In an embodiment, the outer collar comprises angled ports. In another embodiment, the outer collar comprises angled jet ports. The outer collar can be made from plastics and/or metal. The outer collar can be milled or molded to include ports. These ports can be fitted with nozzles or otherwise nozzles formed therein.

In an embodiment, the outer collar can be fitted with brushes and wipers made of flexible materials or blades made of hardened material. In another embodiment, the cleaning tool can be fitted with an adjustable, i.e. actionable, sleeve. The sleeve allows for the selective activation and deactivation of the cleaning tool. The sleeve can be acted upon either using a mechanical or electromechanical force. Depending on operational requirements, activation can be completed using balls, darts dropped through the running tool, shifting via set down weight like the Turbo Tech® II from Halliburton, a power source, or electromagnetic signals, such as RE signals.

The cleaning tool can be tripped to the location that needs to be cleaned, fluid can be circulated through the ID of the running tool, i.e. drill string, and out through the jet ports allowing for a 360° cleaning of the annulus of the casing without any rotation, or any significant rotation, of the running tool. The advantage is that the ID of the casing can be cleaned without any significant risk of damage to the casing and use of the tool, i.e. activating/deactivating, doesn't require tripping in and out of the well.

Referring now to FIG. 1, illustrated is a diagram of a well site where cleaning operations are performed, in accordance with certain example embodiments, denoted generally as 10. The site 10 comprises a pump and controller station 12, a running tool 14, a drill bit 16, for performing operations other than cleaning, and a cleaning tool 18. The pump and controller station 12 is used to pump well fluid through the running tool 14 and the controller station is used to control operation of the running tool 14 and electromechanical communications to and from the cleaning tool 18. The site 10 further includes well casing 20, liner 22, and liner hanger 24. The liner 22 includes polished receptacles and it is the function of the cleaning tool to clean the ID of liner 22 without causing damage. Well fluid can be pumped from the station 12 through the ID of the running tool and through the drill bit 16 and running tool 18. The fluid flow through the cleaning tool 18 causes an outer sleeve of the cleaning tool 18 to rotate while the running tool remains stationary, or relatively stationary with respect to the cleaning tool. In essence, rotation of the cleaning tool 18, or parts of, does not impart any force or enough force on remaining parts of the running tool 16 to cause the string to oscillate or vibrate.

Figure 2A:
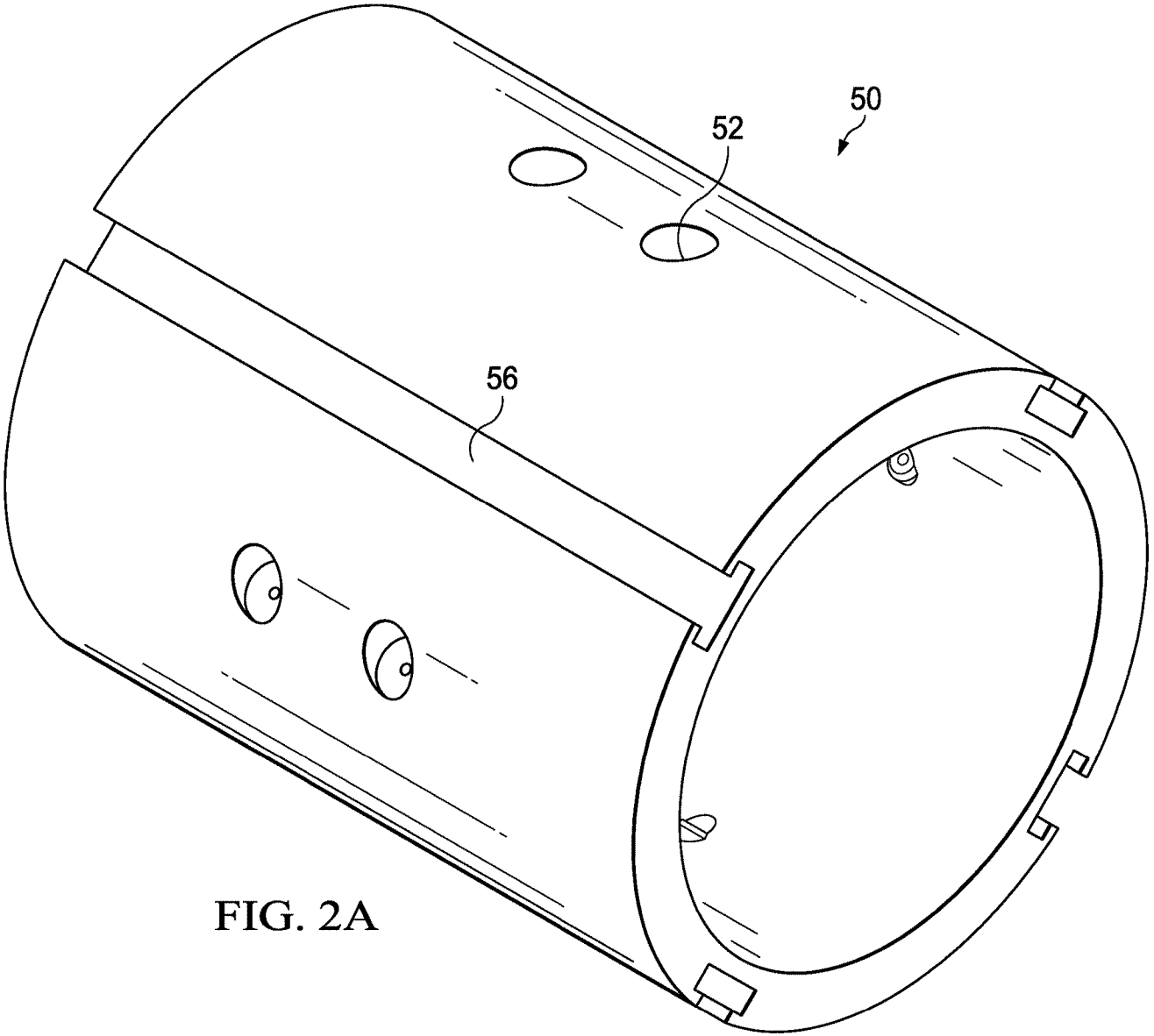
FIGS. 2A and 2B are illustrations of an isometric view and a cut-away view of an outer collar for a cleaning tool, in accordance with certain example embodiments.
Figure 2B:
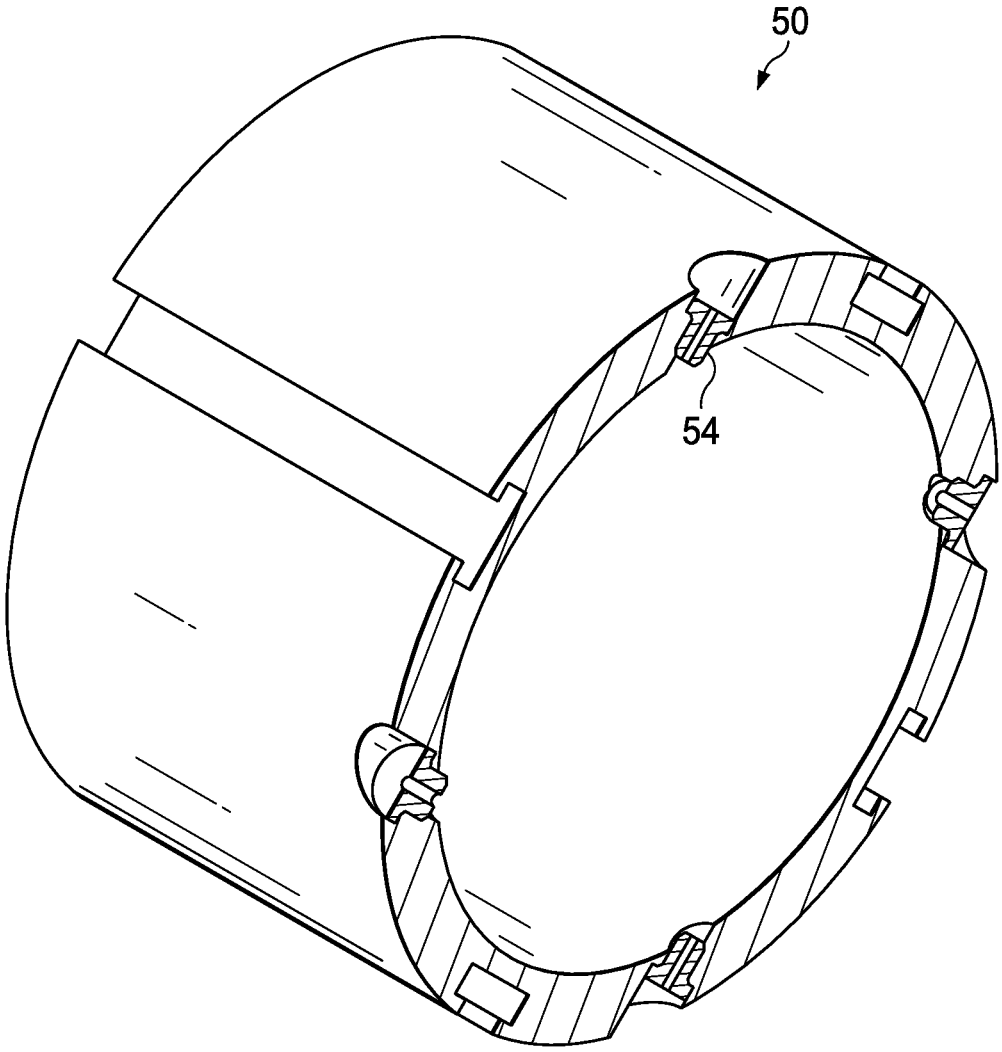

Referring now to FIGS. 2A and 2B, illustrated are an isometric view and a cut-away isometric view of an outer collar for cleaning tool 18, in accordance with certain example, embodiments, denoted generally as 50. The outer collar 50 can be made of plastic, e.g. PVC, or metal or metal composite. The outer collar 50 includes ports 52 and the ports 52 can include nozzles 54. The nozzles 54 can be formed with the outer collar 50 or can be after market, threaded nozzles fitted with the outer collar 50. The outer collar 50 can also include slots 56 for receiving different cleaning apparatus', such as brushes, wipers, and blades. Although the outer collar 50 can include threaded holes instead of slots 56, or a combination of the two. The cleaning apparatus' can be made of flexible or hardened materials. The flexible material can be one of rubber, wire, nylon, polyester, or combination thereof and the hardened material can comprise at least one metal. Although the hardened cleaning apparatus may not be ideal for cleaning a polished surface area, the running tool may be fitted with multiple cleaning tools 18 where one may be used to clean liner 22, i.e. a newly installed highly, polished liner, and the other used to clean a previously developed casing section that does not require gentle cleaning but rather a hard cleaning.

Figure 3:
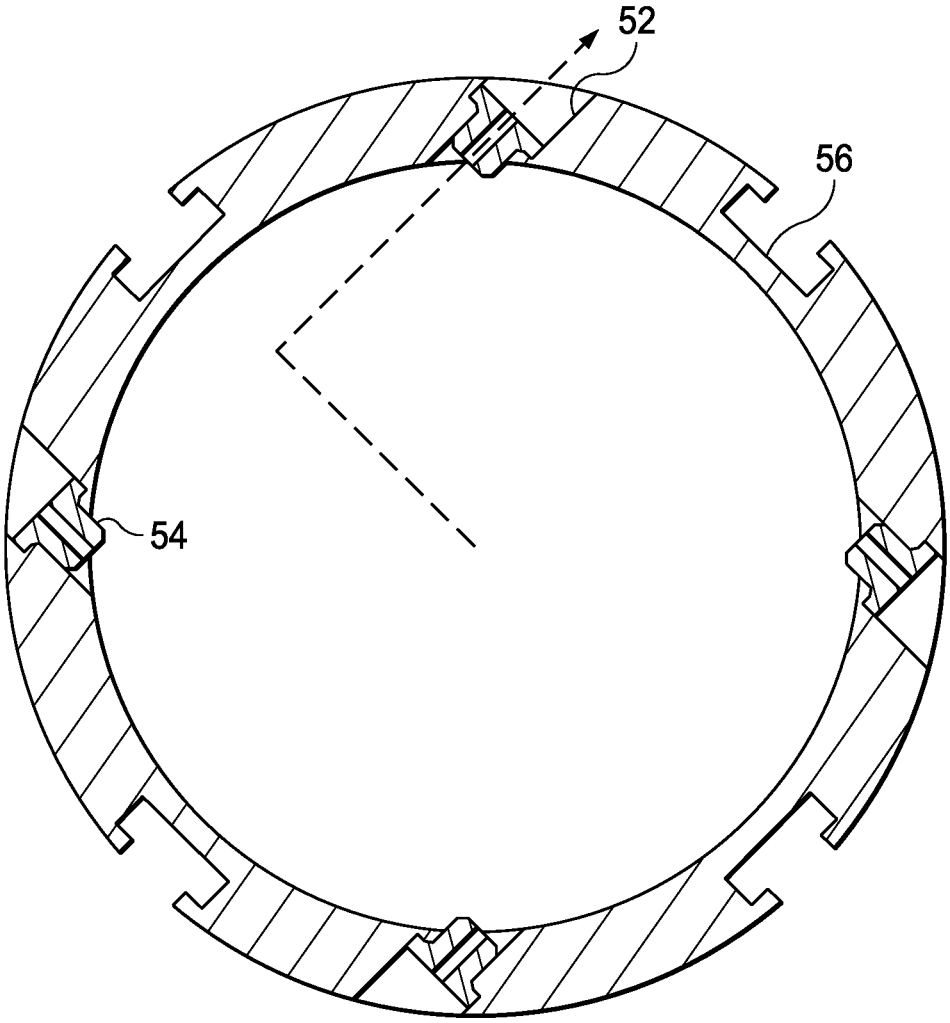
FIG. 3 is an illustration of a cut-away side view of the outer collar, in accordance with certain example embodiments.
Figure 4:
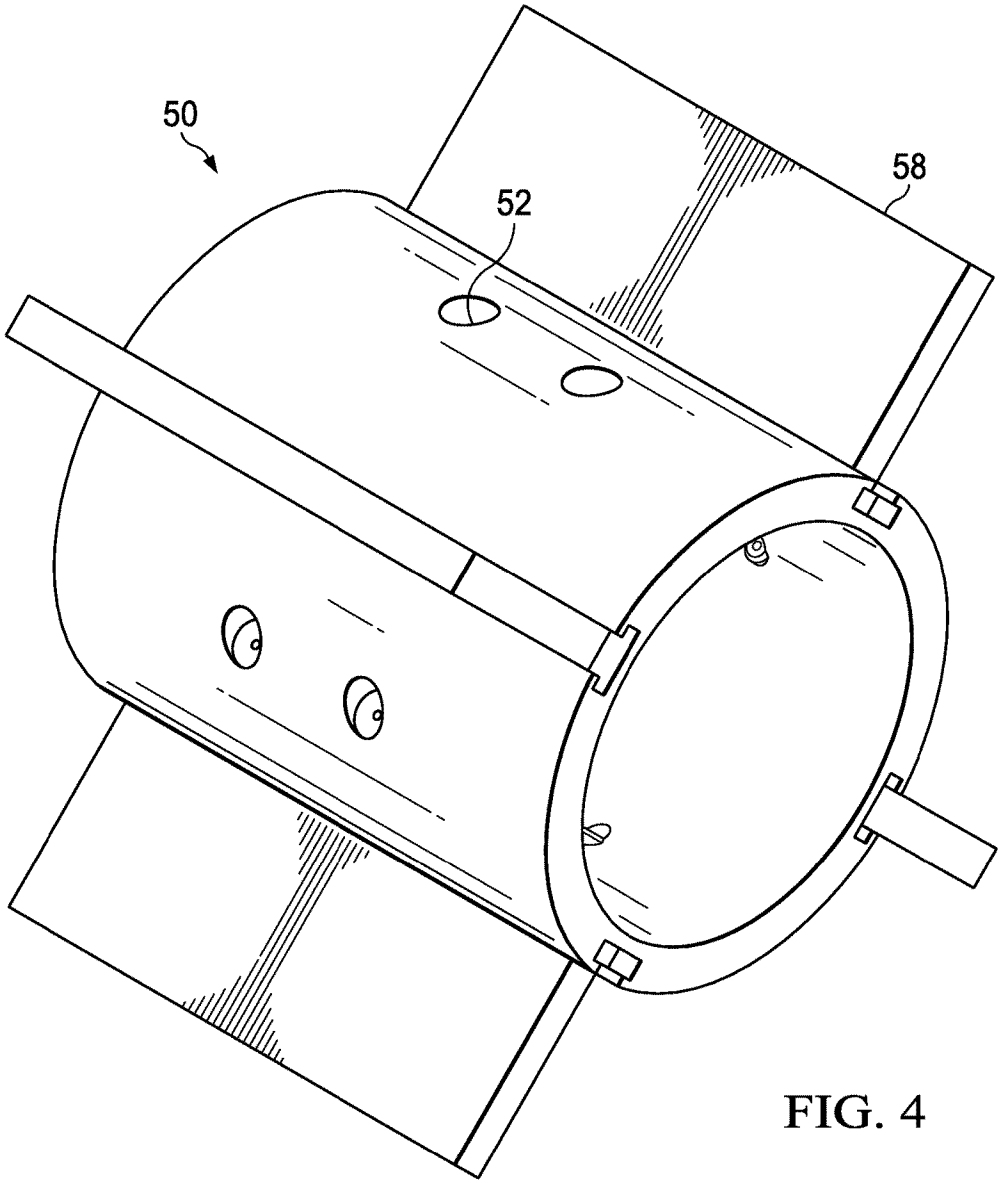
FIG. 4 is an illustration of an isometric view of the outer collar with flexible wipers attached thereto, in accordance with certain example embodiments.

FIG. 3 is a cut-away side view of the outer collar 50. As is illustrated, the ports 52 are angled from a radial of the outer collar 50. The angled ports 52 and nozzle 54, i.e. angled jet port, are angled in a way that a portion of force generated by the fluid flow through the jet ports induce rotation of the outer collar in the opposite direction of the fluid flow. FIG. 4 is an isometric view of the outer collar 50 with flexible wipers 58 attached thereto. Although other cleaning apparatus' can be used and the outer collar 50 can obviously be fitted with other mechanisms for receiving the cleaning apparatus'.

Figure 5A:
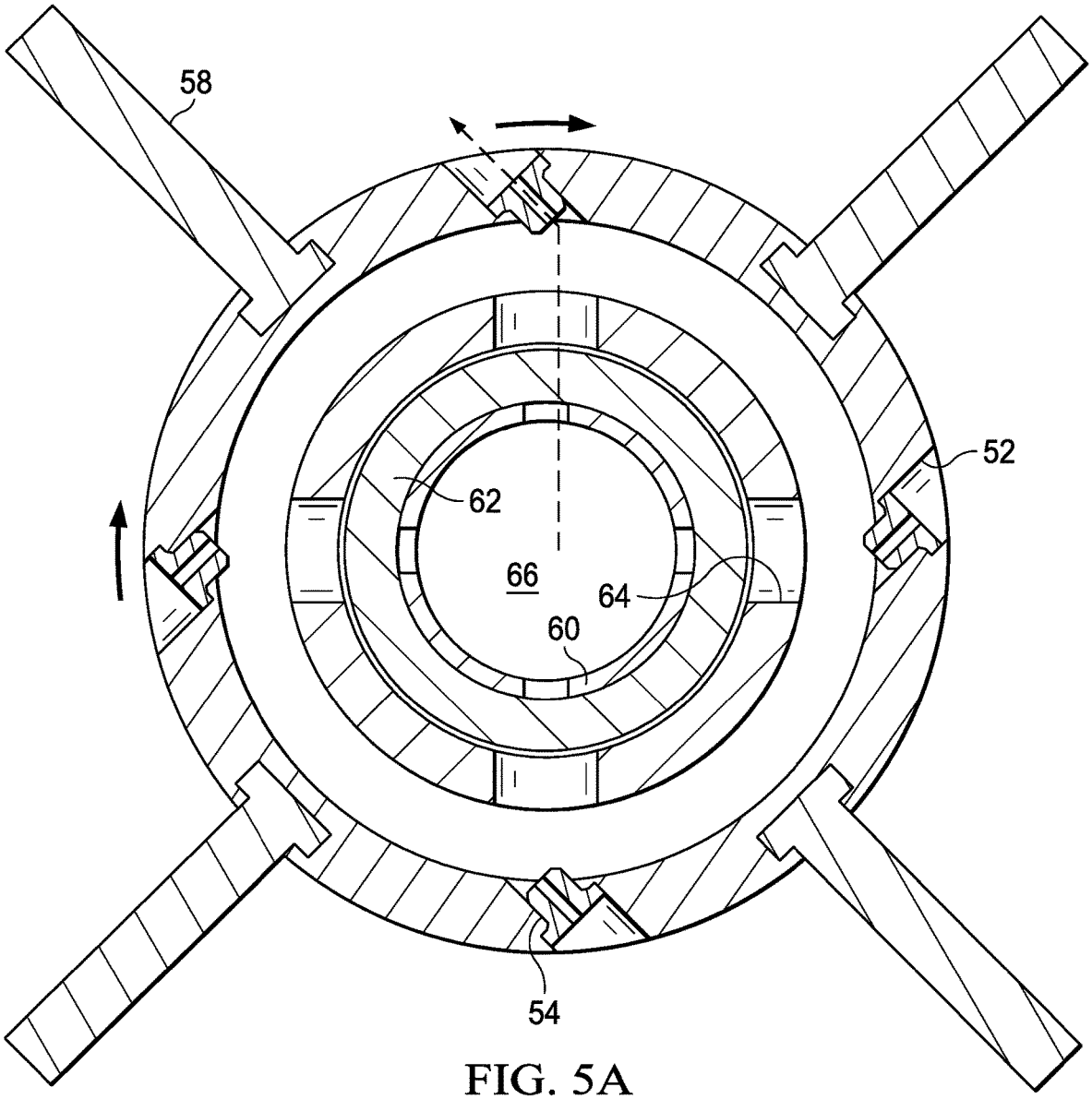
FIGS. 5A-5C are illustrations of a cross sectional view of the cleaning tool, a side view of the cleaning tool having an actionable sleeve, and a control algorithm for controlling a sleeve actuator, respectively, in accordance with certain example embodiments.
Figure 5B:
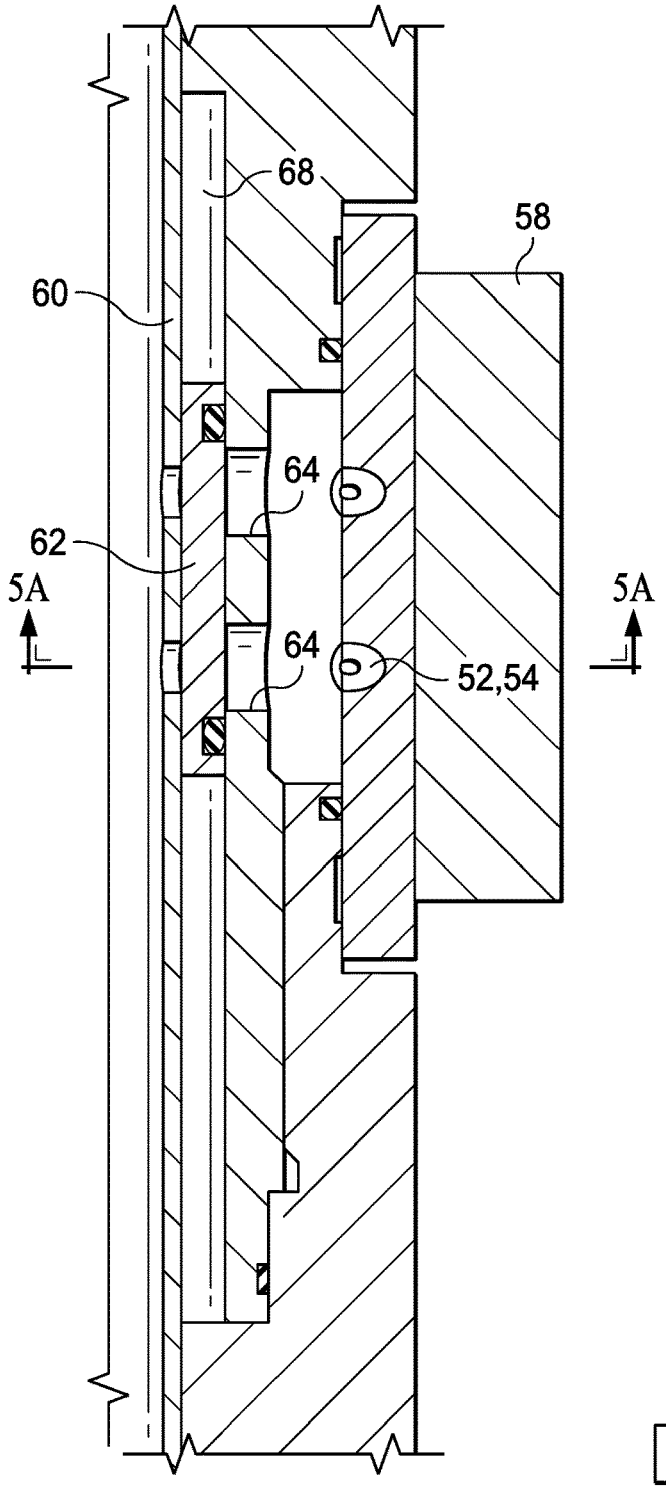
Figure 5C:
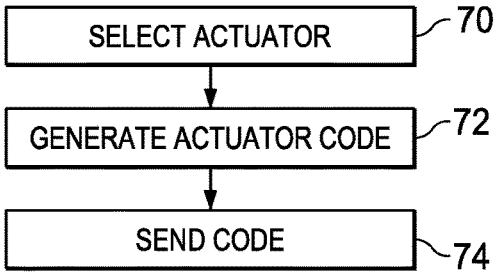

Referring now to FIGS. 5A-5C, illustrated a cross sectional view of cleaning tool 18, a side view of cleaning tool 18 having an actionable sleeve, and a control algorithm for controlling a sleeve actuator, in accordance with certain example embodiments, respectively. The cleaning tool comprises 18 comprises the outer collar 50 and an inner collar. The inner collar includes a main body 60, an actionable sleeve 62, and at least one flow port 64. The main body 60 of the inner collar can be coupled with and fixed to the running tool 14. The actionable sleeve 62 can be adjusted to open and close the flow ports 64 so that fluid flowing through the ID 66 of the running tool 14 can be channeled through the flow ports 64 and into the flow jets 52, 54 when needed. A sleeve actuator 68, see FIG. 5B, can be mechanically controlled or electromechanically controlled. The mechanical means by which the actuator 68 can be tripped will be discussed in reference to FIGS. 6 and 7. In the case of an electromechanically controlled actuator, the actuator 68 includes control logic that can be activated using a simple power source, e.g. simply on or off—much like a light switch, with power deliver from the controller station 12 through a power line or through encoded signals generated and sent from the controller station 12. In the latter case, see FIG. 5C, an actuator can be selected, block 70. This feature can be optional. However, in the event multiple cleaning devices need to be controlled, the option allows for the selective operation of the devices. Once an actuator is selected, the code for the specific actuator is generated, block 72, and the code sent to the selected actuator, block 74, whereupon the actuator 68 causes the sleeve 62 to slide to a position that either opens or closes the flow ports 64.

Figure 6A:
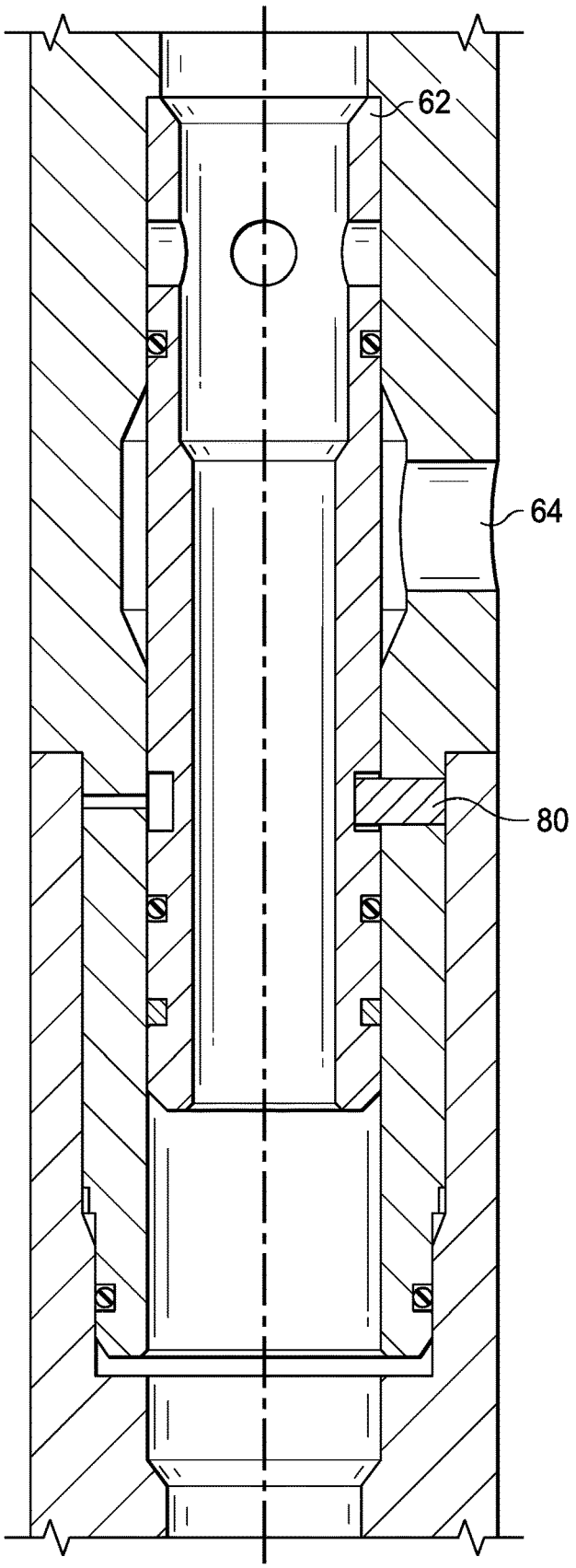
FIGS. 6A and 6B are illustrations of cut-away views of a mechanically controllable actionable sleeve 62 in a closed and open position, respectively, in accordance with certain example embodiments.
Figure 6B:
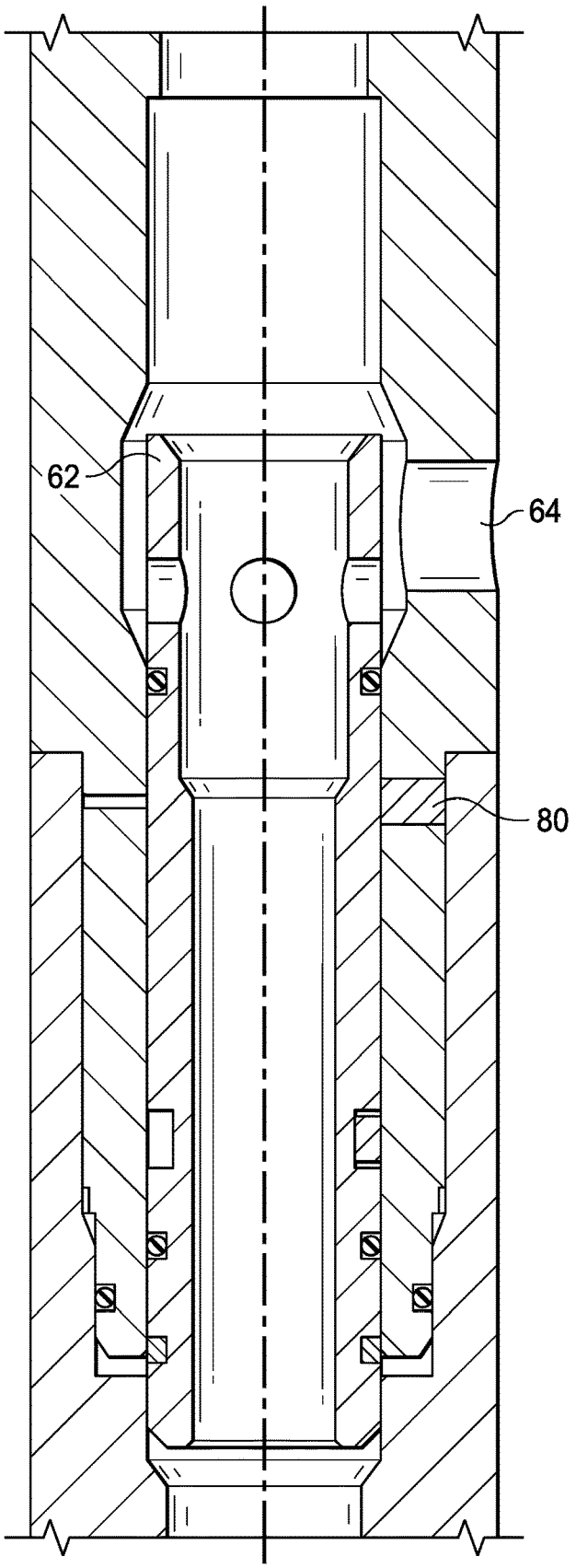

Referring now to FIGS. 6A and 6B, illustrated are cut-away views of a mechanically controllable actionable sleeve 62 in a closed and open position, respectively, according to certain example embodiments. The actionable sleeve, in this embodiment, can be controlled using mechanical force delivered to the sleeve 62. A sheer screw 80, or screws, can be used to maintain the sleeve in the closed position, FIG. 6A, so that there is no fluid flow through the flow ports 64. A ball, not illustrated, can be used to create the mechanical force necessary to break sheer screws 80 allowing the sleeve to move to the open position, FIG. 6B, exposing the flow ports 64 to the ID 66 and the fluid flow therein.

Figure 7:
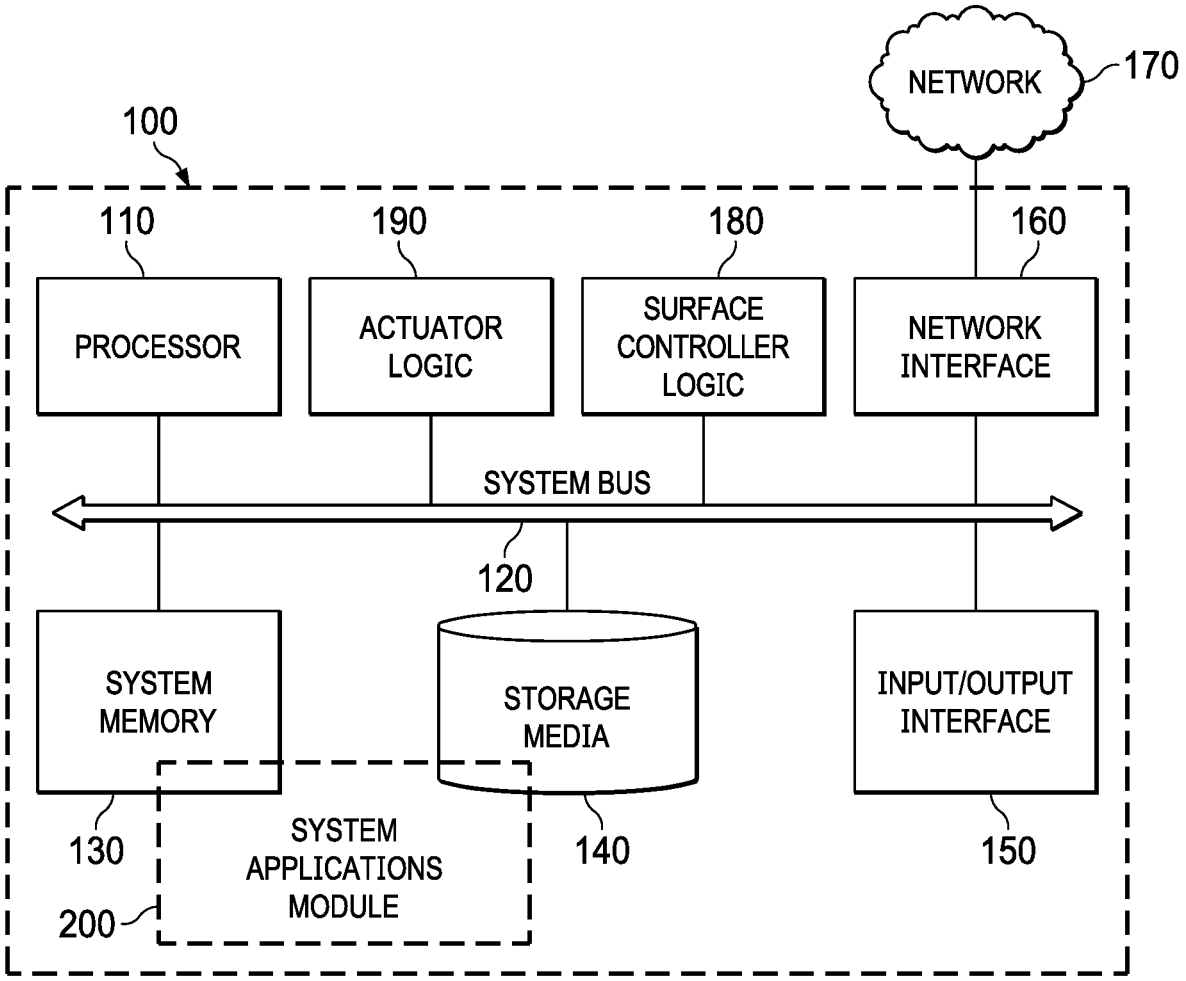
FIG. 7 is an illustration of a computing machine and system applications module, in accordance with example embodiments.

Referring now to FIG. 7, illustrated is a computing machine 100 and a system applications module 200, in accordance with example embodiments. The computing machine 100 can correspond to any of the various computers, mobile devices, laptop computers, servers, embedded systems, or computing systems presented herein. The module 200 can comprise one or more hardware or software elements, e.g. other OS application and user and kernel space applications, designed to facilitate the computing machine 100 in performing the various methods and processing functions presented herein. The computing machine 100 can include various internal or attached components such as a processor 110, system bus 120, system memory 130, storage media 140, input/output interface 150, and a network interface 160 for communicating with a network 170, e.g. a loopback, local network, wide-area network, cellular/GPS, Bluetooth, WIFI, and WIMAX for sending actuator control codes. The computing machine 100 further includes a surface controller logic 180 for processing commands and generating and sending actuator control codes and an actuator controller logic 190 for controlling the actuator based on the received control code.

The computing machine 100 can be implemented as a conventional computer system, an embedded controller, a laptop, a server, a mobile device, a smartphone, a wearable computer, a customized machine, any other hardware platform, or any combination or multiplicity thereof. The computing machine 100 and associated logic and modules can be a distributed system configured to function using multiple computing machines interconnected via a data network and/or bus system.

The processor 110 can be designed to execute code instructions in order to perform the operations and functionality described herein, manage request flow and address mappings, and to perform calculations and generate commands. The processor 110 can be configured to monitor and control the operation of the components in the computing machines. The processor 110 can be a general purpose processor, a processor core, a multiprocessor, a reconfigurable processor, a microcontroller, a digital signal processor ("DSP"), an application specific integrated circuit ("ASIC"), a controller, a state machine, gated logic, discrete hardware components, any other processing unit, or any combination or multiplicity thereof. The processor 110 can be a single processing unit, multiple processing units, a single processing core, multiple processing cores, special purpose processing cores, co-processors, or any combination thereof. According to certain embodiments, the processor 110 along with other components of the computing machine 100 can be a software based or hardware based virtualized computing machine executing within one or more other computing machines.

The system memory 130 can include non-volatile memories such as read-only memory ("ROM"), programmable read-only memory ("PROM"), erasable programmable read-only memory ("EPROM"), flash memory, or any other device capable of storing program instructions or data with or without applied power. The system memory 130 can also include volatile memories such as random access memory ("RAM"), static random access memory ("SRAM"), dynamic random access memory ("DRAM"), and synchronous dynamic random access memory ("SDRAM"). Other types of RAM also can be used to implement the system memory 130. The system memory 130 can be implemented using a single memory module or multiple memory modules. While the system memory 130 is depicted as being part of the computing machine, one skilled in the art will recognize that the system memory 130 can be separate from the computing machine 100 without departing from the scope of the subject technology. It should also be appreciated that the system memory 130 can include, or operate in conjunction with, a non-volatile storage device such as the storage media 140.

The storage media 140 can include a hard disk, a floppy disk, a compact disc read-only memory ("CD-ROM"), a digital versatile disc ("DVD"), a Blu-ray disc, a magnetic tape, a flash memory, other non-volatile memory device, a solid state drive ("SSD"), any magnetic storage device, any optical storage device, any electrical storage device, any semiconductor storage device, any physical-based storage device, any other data storage device, or any combination or multiplicity thereof. The storage media 140 can store one or more operating systems, application programs and program modules, data, or any other information. The storage media 140 can be part of, or connected to, the computing machine. The storage media 140 can also be part of one or more other computing machines that are in communication with the computing machine such as servers, database servers, cloud storage, network attached storage, and so forth.

The applications module 200 and other OS application modules, i.e. the actuator logic 190 and surface controller logic 180, can comprise one or more hardware or software elements configured to facilitate the computing machine with performing the various methods and processing functions presented herein. The applications module 200 and other OS application modules can include one or more algorithms or sequences of instructions stored as software or firmware in association with the system memory 130, the storage media 140 or both. The storage media 140 can therefore represent examples of machine or computer readable media on which instructions or code can be stored for execution by the processor 110. Machine or computer readable media can generally refer to any medium or media used to provide instructions to the processor 110. Such machine or computer readable media associated with the applications module 200 and other OS application modules can comprise a computer software product. It should be appreciated that a computer software product comprising the applications module 200 and other OS application modules can also be associated with one or more processes or methods for delivering the applications module 200 and other OS application modules to the computing machine via a network, any signal-bearing medium, or any other communication or delivery technology. The applications module 200 and other OS application modules can also comprise hardware circuits or information for configuring hardware circuits such as microcode or configuration information for an FPGA or other PLD. In one exemplary embodiment, applications module 200 and other OS application modules can include algorithms capable of performing the functional operations described by the flow charts and computer systems presented herein.

The input/output ("I/O") interface 150 can be configured to couple to one or more external devices, to receive data from the one or more external devices, and to send data to the one or more external devices. Such external devices along with the various internal devices can also be known as peripheral devices. The I/O interface 150 can include both electrical and physical connections for coupling the various peripheral devices to the computing machine or the processor 110. The I/O interface 150 can be configured to communicate data, addresses, and control signals between the peripheral devices, the computing machine, or the processor 110. The I/O interface 150 can be configured to implement any standard interface, such as small computer system interface ("SCSI"), serial-attached SCSI ("SAS"), fiber channel, peripheral component interconnect ("PCI"), PCI express (PCIe), serial bus, parallel bus, advanced technology attached ("ATA"), serial ATA ("SATA"), universal serial bus ("USB"), Thunderbolt, FireWire, various video buses, and the like. The I/O interface 150 can be configured to implement only one interface or bus technology. Alternatively, the I/O interface 150 can be configured to implement multiple interfaces or bus technologies. The I/O interface 150 can be configured as part of, all of, or to operate in conjunction with, the system bus 120. The I/O interface 150 can include one or more buffers for buffering transmissions between one or more external devices, internal devices, the computing machine, or the processor 120.

The I/O interface 120 can couple the computing machine to various input devices including mice, touch-screens, scanners, electronic digitizers, sensors, receivers, touchpads, trackballs, cameras, microphones, keyboards, any other pointing devices, or any combinations thereof. The I/O interface 120 can couple the computing machine to various output devices including video displays, speakers, printers, projectors, tactile feedback devices, automation control, robotic components, actuators, motors, fans, solenoids, valves, pumps, transmitters, signal emitters, lights, and so forth.

The computing machine 100 can operate in a networked environment using logical connections through the NIC 160 to one or more other systems or computing machines across a network. The network can include wide area networks (WAN), local area networks (LAN), intranets, the Internet, wireless access networks, wired networks, mobile networks, telephone networks, optical networks, or combinations thereof. The network can be packet switched, circuit switched, of any topology, and can use any communication protocol. Communication links within the network can involve various digital or an analog communication media such as fiber optic cables, free-space optics, waveguides, electrical conductors, wireless links, antennas, radio-frequency communications, and so forth.

The processor 110 can be connected to the other elements of the computing machine or the various peripherals discussed herein through the system bus 120. It should be appreciated that the system bus 120 can be within the processor 110, outside the processor 110, or both. According to some embodiments, any of the processors 110, the other elements of the computing machine, or the various peripherals discussed herein can be integrated into a single device such as a system on chip ("SOC"), system on package ("SOP"), or ASIC device.

Embodiments may comprise a computer program that embodies the functions described and illustrated herein, wherein the computer program is implemented in a computer system that comprises instructions stored in a machine-readable medium and a processor that executes the instructions. However, it should be apparent that there could be many different ways of implementing embodiments in computer programming, and the embodiments should not be construed as limited to any one set of computer program instructions unless otherwise disclosed for an exemplary embodiment. Further, a skilled programmer would be able to write such a computer program to implement an embodiment of the disclosed embodiments based on the appended flow charts, algorithms and associated description in the application text. Therefore, disclosure of a particular set of program code instructions is not considered necessary for an adequate understanding of how to make and use embodiments. Further, those skilled in the art will appreciate that one or more aspects of embodiments described herein may be performed by hardware, software, or a combination thereof, as may be embodied in one or more computing systems. Moreover, any reference to an act being performed by a computer should not be construed as being performed by a single computer as more than one computer may perform the act.

The example embodiments described herein can be used with computer hardware and software that perform the methods and processing functions described previously. The systems, methods, and procedures described herein can be embodied in a programmable computer, computer-executable software, or digital circuitry. The software can be stored on computer-readable media. For example, computer-readable media can include a floppy disk, RAM, ROM, hard disk, removable media, flash memory, memory stick, optical media, magneto-optical media, CD-ROM, etc. Digital circuitry can include integrated circuits, gate arrays, building block logic, field programmable gate arrays (FPGA), etc.

The example systems, methods, and acts described in the embodiments presented previously are illustrative, and, in alternative embodiments, certain acts can be performed in a different order, in parallel with one another, omitted entirely, and/or combined between different example embodiments, and/or certain additional acts can be performed, without departing from the scope and spirit of various embodiments. Accordingly, such alternative embodiments are included in the description herein.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

As used herein, "hardware" can include a combination of discrete components, an integrated circuit, an application-specific integrated circuit, a field programmable gate array, or other suitable hardware. As used herein, "software" can include one or more objects, agents, threads, lines of code, subroutines, separate software applications, two or more lines of code or other suitable software structures operating in two or more software applications, on one or more processors (where a processor includes one or more microcomputers or other suitable data processing units, memory devices, input-output devices, displays, data input devices such as a keyboard or a mouse, peripherals such as printers and speakers, associated drivers, control cards, power sources, network devices, docking station devices, or other suitable devices operating under control of software systems in conjunction with the processor or other devices), or other suitable software structures. In one exemplary embodiment, software can include one or more lines of code or other suitable software structures operating in a general purpose software application, such as an operating system, and one or more lines of code or other suitable software structures operating in a specific purpose software application. As used herein, the term "couple" and its cognate terms, such as "couples" and "coupled," can include a physical connection (such as a copper conductor), a virtual connection (such as through randomly assigned memory locations of a data memory device), a logical connection (such as through logical gates of a semiconducting device), other suitable connections, or a suitable combination of such connections. The term "data" can refer to a suitable structure for using, conveying or storing data, such as a data field, a data buffer, a data message having the data value and sender/receiver address data, a control message having the data value and one or more operators that cause the receiving system or component to perform a function using the data, or other suitable hardware or software components for the electronic processing of data.

In general, a software system is a system that operates on a processor to perform predetermined functions in response to predetermined data fields. For example, a system can be defined by the function it performs and the data fields that it performs the function on. As used herein, a NAME system, where NAME is typically the name of the general function that is performed by the system, refers to a software system that is configured to operate on a processor and to perform the disclosed function on the disclosed data fields. Unless a specific algorithm is disclosed, then any suitable algorithm that would be known to one of skill in the art for performing the function using the associated data fields is contemplated as falling within the scope of the disclosure. For example, a message system that generates a message that includes a sender address field, a recipient address field and a message field would encompass software operating on a processor that can obtain the sender address field, recipient address field and message field from a suitable system or device of the processor, such as a buffer device or buffer system, can assemble the sender address field, recipient address field and message field into a suitable electronic message format (such as an electronic mail message, a TCP/IP message or any other suitable message format that has a sender address field, a recipient address field and message field), and can transmit the electronic message using electronic messaging systems and devices of the processor over a communications medium, such as a network. One of ordinary skill in the art would be able to provide the specific coding for a specific application based on the foregoing disclosure, which is intended to set forth exemplary embodiments of the present disclosure, and not to provide a tutorial for someone having less than ordinary skill in the art, such as someone who is unfamiliar with programming or processors in a suitable programming language. A specific algorithm for performing a function can be provided in a flow chart form or in other suitable formats, where the data fields and associated functions can be set forth in an exemplary order of operations, where the order can be rearranged as suitable and is not intended to be limiting unless explicitly stated to be limiting.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. The scope of the claims is intended to broadly cover the disclosed embodiments and any such modification. Further, the following clauses represent additional embodiments of the disclosure and should be considered within the scope of the disclosure:

Clause 1, a system for use with a tool string to clean well casing in a downhole well operation, the system comprising: an inner collar comprising and at least one flow port; and an outer collar comprising at least one jet port in fluid communication with the at least one flow port; wherein the inner collar couples with a section of the tool string and the outer collar rotates about the inner collar in response to fluid flow through the tool string;

Clause 2, the system of clause 1 wherein the inner collar further comprises an actionable sleeve, wherein the actionable sleeve is moveable from a first position to a second position causing the at least one jet to be in fluid communication with the at least one flow port in response to the fluid flow through the tool string;

Clause 3, the system of clause 1 wherein the inner collar remains relatively stationary with respect to the rotation of the outer collar;

Clause 4, the system of clause 1 wherein the at least one jet port is angled in a way that a portion of force generated by the fluid flow through the jet ports induce rotation of the outer collar in the opposite direction of the fluid flow;

Clause 5, the system of clause 1 wherein the outer collar comprises at least one: at least one wiper made of flexible material; a brush made of flexible material; and a blade made of hardened material;

Clause 6, the system of clause 5 wherein the flexible material is one of rubber, wire, nylon, polyester, or combination thereof and the hardened material comprises at least one metal;

Clause 7, The system of clause 5 wherein the at least one wiper, the brush, and the blade are attachable and detachable;

Clause 8, the system of clause 1 further comprising at least one of: at least one bushing; at least one rotary seal; wherein the at least one bushing and the at least one rotary seal are in communication with the outer sleeve and the inner sleeve;

Clause 9, an apparatus for use with a tool string to clean well casing in a downhole well operation, the apparatus comprising: an inner collar comprising at least one flow port; and an outer collar comprising at least one jet port in fluid communication with the at least one flow port; wherein the inner collar couples with a section of the tool string and the outer collar rotates about the inner collar in response to fluid flow through the at least one flow port;

Clause 10, the apparatus of clause 9 wherein the inner collar further comprises an actionable sleeve, wherein the actionable sleeve is moveable from a first position to a second position causing the at least one jet to be in fluid communication with the at least one flow port in response to the fluid flow through the at least one flow port;

Clause 11, the apparatus of clause 9 wherein the inner collar remains relatively stationary with respect to the rotation of the outer collar;

Clause 12, the apparatus of clause 9 wherein the at least one jet port is angled in a way that a portion of force generated by the fluid flow through the jet ports induce rotation of the outer collar in the opposite direction of the fluid flow;

Clause 13, the apparatus of clause 9 wherein the outer collar comprises at least one: at least one wiper made of flexible material; a brush made of flexible material; and a blade made of hardened material;

Clause 14, the apparatus of clause 13 wherein the flexible material is one of rubber, wire, nylon, polyester, or combination thereof and the hardened material comprises at least one metal;

Clause 15, the apparatus of clause 13 wherein the at least one wiper, the brush, and the blade are attachable and detachable;

Clause 16, the apparatus of clause 9 further comprising at least one of: at least one bushing; at least one rotary seal; wherein the at least one bushing and the at least one rotary seal are in communication with the outer sleeve and the inner sleeve;

Clause 17, a method for use with a tool string to clean well casing in a downhole well operation, the method comprising: pumping fluid down the tool string; activating a cleaning apparatus coupled to the tool string, wherein the cleaning apparatus comprises: an inner collar coupled with the tool string and comprising and at least one flow port; and an outer collar comprising at least one jet port in fluid communication with the at least one flow port; wherein the outer collar rotates about the inner collar in response to fluid flow through the tool string;

Clause 18, a method of clause 17 wherein the inner collar further comprises an actionable sleeve, wherein the actionable sleeve is moveable from a first position to a second position causing the at least one jet to be in fluid communication with the at least one flow port in response to the fluid flow through the tool string;

Clause 19, the method of clause 17 wherein the inner collar remains relatively stationary with respect to the rotation of the outer collar; and Clause 20, the method of clause 17 wherein the at least one jet port is angled in a way that a portion of force generated by the fluid flow through the jet ports induce rotation of the outer collar in the opposite direction of the fluid flow.

What is claimed is:

1. A system for use with a tool string to clean well casing in a downhole well operation, the system comprising:

an inner collar comprising at least one flow port; and an outer collar comprising at least one jet port in fluid communication with the at least one flow port;

wherein the inner collar extends along an exterior section of the tool string such that fluid flowing through an inner diameter of the tool string is channeled through the at least one flow port into the at least one jet port, and wherein the outer collar rotates about the inner collar in response to fluid flow through the tool string.

2. The system of claim 1 wherein the inner collar further comprises an actionable sleeve, wherein the actionable sleeve is moveable from a first position to a second position causing the at least one jet port to be in fluid communication with the at least one flow port in response to the fluid flow through the tool string.

3. The system of claim 1 wherein the inner collar remains relatively stationary with respect to the rotation of the outer collar.

4. The system of claim 1 wherein the at least one jet port is angled in a way that a portion of force generated by the fluid flow through the jet ports induce rotation of the outer collar in the opposite direction of the fluid flow.

5. The system of claim 1 wherein the outer collar comprises at least one:

at least one wiper made of flexible material;

a brush made of flexible material; and a blade made of hardened material.

6. The system of claim 5 wherein the flexible material is one of rubber, wire, nylon, polyester, or combination thereof and the hardened material comprises at least one metal.

7. The system of claim 5 wherein the at least one wiper, the brush, and the blade are attachable and detachable.

8. An apparatus for use with a tool string to clean well casing in a downhole well operation, the apparatus comprising:

an inner collar comprising at least one flow port; and an outer collar comprising at least one jet port in fluid communication with the at least one flow port;

wherein the inner collar extends along an exterior section of the tool string such that fluid flowing through an inner diameter of the tool string is channeled through the at least one flow port into the at least one jet port, and wherein the outer collar rotates about the inner collar in response to fluid flow through the at least one flow port.

9. The apparatus of claim 8 wherein the inner collar further comprises an actionable sleeve, wherein the actionable sleeve is moveable from a first position to a second position causing the at least one jet port to be in fluid communication with the at least one flow port in response to the fluid flow through the at least one flow port.

10. The apparatus of claim 8 wherein the inner collar remains relatively stationary with respect to the rotation of the outer collar.

11. The apparatus of claim 8 wherein the at least one jet port is angled in a way that a portion of force generated by the fluid flow through the jet ports induce rotation of the outer collar in the opposite direction of the fluid flow.

12. The apparatus of claim 8 wherein the outer collar comprises at least one:

at least one wiper made of flexible material;

a brush made of flexible material; and a blade made of hardened material.

13. The apparatus of claim 12 wherein the flexible material is one of rubber, wire, nylon, polyester, or combination thereof and the hardened material comprises at least one metal.

14. The apparatus of claim 12 wherein the at least one wiper, the brush, and the blade are attachable and detachable.

15. A method for use with a tool string to clean well casing in a downhole well operation, the method comprising:

pumping fluid down the tool string;

activating a cleaning apparatus coupled to the tool string, wherein the cleaning apparatus comprises:

an inner collar extends along an exterior section of the tool string and comprising at least one flow port; and an outer collar comprising at least one jet port in fluid communication with the at least one flow port;

wherein fluid flowing through an inner diameter of the tool string is channeled through the at least one flow port into the at least one jet port, and wherein the outer collar rotates about the inner collar in response to fluid flow through the tool string.

16. The method of claim 15 wherein the inner collar further comprises an actionable sleeve, wherein the actionable sleeve is moveable from a first position to a second position causing the at least one jet port to be in fluid communication with the at least one flow port in response to the fluid flow through the tool string.

17. The method of claim 15 wherein the inner collar remains relatively stationary with respect to the rotation of the outer collar.

18. The method of claim 15 wherein the at least one jet port is angled in a way that a portion of force generated by the fluid flow through the jet ports induce rotation of the outer collar in the opposite direction of the fluid flow.

* * * * *